United States Patent [19]

Brookes

[11] 4,276,922

[45] Jul. 7, 1981

[54] PLUG MOLD ASSEMBLY

[75] Inventor: Ronald R. Brookes, North Canton, Ohio

[73] Assignee: TRW Inc., Cleveland, Ohio

[21] Appl. No.: 908,804

[22] Filed: May 24, 1978

[51] Int. Cl.[2] ..... B22C 9/10; B22C 9/00

[52] U.S. Cl. ..... 164/27; 164/23; 164/30; 164/34; 164/45

[58] Field of Search ..... 164/23–28, 164/30, 34, 45

[56] References Cited

U.S. PATENT DOCUMENTS

| | | | |
|---|---|---|---|
| Re.26,495 | 12/1968 | Watts et al. | 164/26 |
| 1,401,577 | 12/1921 | Becker | 164/28 |
| 2,848,774 | 8/1958 | Petty | 164/23 |
| 3,041,688 | 7/1962 | Wilder | 164/25 |
| 3,186,041 | 6/1965 | Horton | 164/34 X |
| 3,426,832 | 2/1969 | Phillips et al. | 164/45 |
| 3,610,314 | 10/1971 | Hochgraf | 164/27 |
| 3,722,577 | 3/1973 | Webb | 164/25 X |
| 3,927,710 | 12/1975 | Hayes et al. | 164/25 |
| 3,981,344 | 9/1976 | Hayes et al. | 164/26 |

FOREIGN PATENT DOCUMENTS

| | | | |
|---|---|---|---|
| 628342 | 6/1948 | United Kingdom | 164/24 |

*Primary Examiner*—Robert D. Baldwin
*Assistant Examiner*—Gus T. Hampilos

[57] ABSTRACT

A method of forming a mold for use in casting is disclosed. The method includes as a first step forming a positive pattern having a surface the shape of a part to be cast. Next a negative partial pattern is formed having a casting surface complimentary to a selected portion of the surface of the positive pattern and also having a reference surface in a fixed spatial relationship with the casting surface. The casting surface of the negative partial pattern is placed in complimentary engagement with the selected portion of the surface of the positive pattern to form a pattern assembly. A first mold section having a surface complimentary to the reference surface and to the surface of the part is formed by dipping the assembly formed in the preceding step in a ceramic material. A second mold section of ceramic material is formed having a casting surface identical to the casting surface of the negative wax partial pattern and a reference surface identical to the negative partial pattern reference surface, the casting and reference surfaces bearing the same spatial relationship to each other as the identical surfaces of the wax partial pattern bear to each other. Finally, a core is attached to one of the mold sections and a complete mold is formed by placing the reference surface of the second mold section in abutting engagement with the complimentary surface of the first mold section.

12 Claims, 12 Drawing Figures

PLUG MOLD ASSEMBLY

BACKGROUND OF THE INVENTION

The present invention relates to the art of casting, and more particularly to a method of making a mold for use in casting and having an accurately positioned core to form an accurately located passage in the finished product.

In the casting of metal it may be desirable to provide a hollow passage through the inside of the finished product. Such a passage may be formed by attaching a ceramic core to the inside of a mold. When molten metal is poured into the mold, the core excludes the metal from the areas occupied by the core. Once the metal has solidified, the mold and the core are removed leaving a casting having a passage of the desired shape.

Problems have been encountered when using this technique to form hollow passages. In some castings the location of the passage in the finished product is critical. Prior known techniques have had difficulty in precisely locating the cores with the result that the passages have not been accurately located. This has resulted in a large number of unsatisfactory castings.

Further difficulties have been encountered when firing a mold with a core attached inside. The prior practice has been to fire the ceramic core in an oven before attaching it to a mold. The fired cores are embedded in a wax pattern of the object to be cast. The wax pattern is then repeatedly dipped in a ceramic slurry to build a "green" coating of ceramic material on the wax pattern. The green mold is then fired in an oven. The firing melts out the wax and hardens the ceramic material into a mold strong enough to withstand the impact of molten metal.

One result of firing a ceramic material is a slight change in the coefficient of thermal expansion. The core which is attached to the inside of the green mold has already been fired. Thus the thermal expansion coefficient of the core differs somewhat from the thermal expansion coefficient of the unfired ceramic material which forms the still green mold. The difference in thermal expansion coefficients can cause either the core or the mold to crack when they are connected with each other and fired. Firing may also cause the core to shift positions.

The damage to the core and the mold occurs during firing. This damage may not be outwardly visable. The damage may only be detectable after the casting has been poured and the once molten metal has hardened. The damage then appears as a passage through the finished piece in the wrong position caused by a shift in the core position. The passage also may be incomplete because of a broken core. This hidden damage is expensive because it cannot be detected until the casting process is complete.

SUMMARY OF THE INVENTION

The present invention provides a new and improved method for making casting molds with interior passages. A mold having a cavity shaped like the desired finished casting is formed in two sections. The two mold sections have mating reference surfaces which permit them to be accurately located with respect to one another. The two green mold sections are fired to dry and harden them, and then an already fired ceramic core is attached to one of the mold sections. The two mold sections, one of which has the core attached, are then assembled together to form a finished mold.

In the practice of the present invention there is no thermal expansion cracking of either the mold or the core during firing of the mold since the core is not connectd to a mold section until after both have been fired. Hidden damage to the mold is almost entirely eliminated because the core and the surfaces which define the mold cavity in both mold sections may be inspected after firing. In addition, the core may be precisely located when it is attached to one of the mold sections. This assures that the passage through the finished casting formed by the core will be accurately located.

These and other objects and features of the present invention will become more apparent from reading the following specification taken together with the accompanying drawings in which:

DESCRIPTION OF ONE PREFERRED EMBODIMENT

Figure 1:
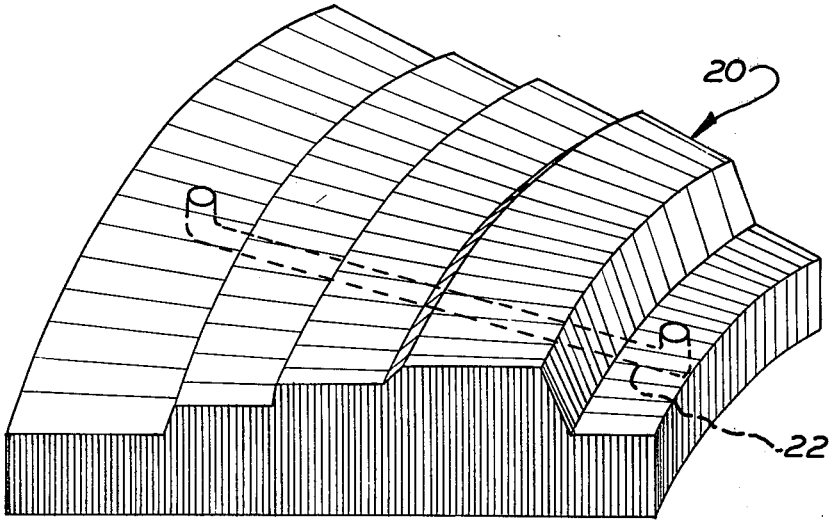
FIG. 1 is a pictorial illustration of a finished casting having an internal passage.

The technique for making a mold disclosed herein is particularly suited to making molds for cast objects which have internal passages. Such an object or article 20 is illustrated in FIG. 1. The cast metal object 20 is used herein for illustrative purposes only. It is to be understood that the methods and techniques herein disclosed are equally applicable to cast objects having different shapes from the shape of the object 20. However, all objects for which this method is particularly well suited do have at least one internal passage, and the passage 22 is typical of such a passage.

The practice of the method for making a mold which comprises the present invention includes the making of a number of castings and patterns, and it is convenient at the outset to establish the terminology which will be used throughout this description and in the claims which follow. The adjective "positive" is used to describe a solid object when the object has an outside surface which is identical to all or a portion of the surface of an object to be cast. By contrast the adjective "negative" is used to describe an object which has a surface which is complementary to all or a portion of the surface of the object to be cast. That is, where the positive object 20 has a bulge or protrusion, a negative cast of the object 20 has a recess or depression which fits the bulge exactly. Thus when a positive surface and its negative compliment are placed in complimentary engagement, the two surfaces mate perfectly, and there are no voids between them. By way of example the word "positive" aptly describes, but is not limited to, the objects illustrated in FIGS. 2, 5, and 7, because they have a surface identical to at least a portion of the surface of the object 20 to be cast (FIG. 1). The word "negative" is appropriate to describe, but not limited to, the objects illustrated in FIGS. 4, 6, 11, and 12.

Figure 2:
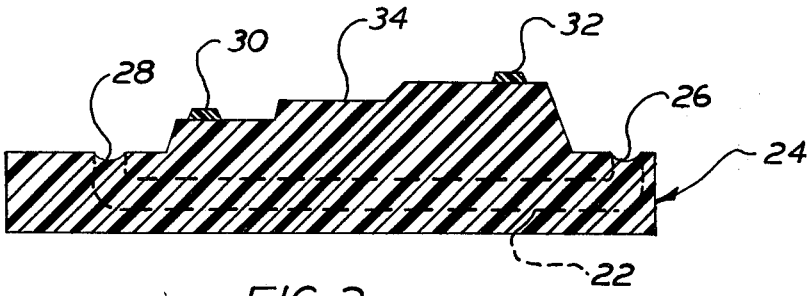
FIG. 2 is a sectional view of a positive wax pattern for the casting shown in FIG. 1 and showing a pair of locating buttons and dashed lines indicating the desired location of the internal passage.

The first step in producing a mold for casting the object 20 (FIG. 1) is to produce a positive wax replica of it. Such a wax pattern 24 is illustrated in FIG. 2 and may be made of any wax or plastic material suitable for use in making molds by the lost wax method. The wax pattern 24 does not have a passage corresponding to the passage 22 (FIG. 1). However, in FIG. 2 the passage 22 is shown in dashed lines to illustrate its eventual location. In addition, the pattern 24 may include recesses or protrusions to mark the location of the ends 26 and 28 of the passage 22.

Wax buttons 30 and 32 are added to the upper surface 34 of the positive wax pattern 24. The buttons 26 and 28 serve as locators to facilitate accurate positioning of subsequent castings which are necessary to practicing the methods and techniques of the present invention.

A fence or retaining wall 38 (FIG. 3) is positioned on the wax pattern 24 so that it surrounds both ends 26 and 28 of the passage 22 and the buttons 30 and 32. The recesses formed in the wax pattern 24 marking the ends 26 and 28 of the passage 22 assist in properly locating the fence 38.

The fence 28 must sealingly engage the upper surface 34 of the wax pattern 24. In the succeeding step the fenced-in area is filled with tooling plaster or a plastic pattern material, and it is important that no plaster seep out of the fenced-in area. A tight seal between the fence 38 and the wax pattern 24 may be achieved by making the fence of metal and heating it before putting it in place. The hot metal fence 28 may then be easily forced into the wax pattern 24 because it causes local melting of the wax. When the wax rehardens a tight seal is formed between the fence 38 and the pattern 24.

The metal fence or retaining wall 38 extends upward from the highest part of the upper surface 34 of the wax pattern 24 a distance at least equal to the thickness of a wall of a ceramic mold.

Once the fence 38 is in place, the area it surrounds is filled with tooling plaster or a plastic pattern material. This forms a negative plaster impression 40 (FIG. 4) of a portion of the wax pattern 24 illustrated in FIGS. 2 and 3. The negative plaster cast 40 forms an intermediate pattern which is used in subsequent steps of the method of the present invention.

The negative plaster cast 40 has a lower surface 41 with a pair of projections 42 and 44 (FIG. 4) which correspond to the recesses 26 and 28 (FIG. 2) of the wax pattern 24. In addition, the buttons 30 and 32 which extend outward from the upper surface 34 of the wax pattern 24 produce complimentary recesses 46 and 48 (FIG. 4) in the negative plaster cast 40.

Handling of the negative plaster cast 40 is facilitated by mounting a board 50 on its upper surface 52. A draft angle may be applied to the perimeter 60 of the plaster cast 40 to facilitate subsequent steps in the process. The draft angle causes the surface of the perimeter 60 of the plaster cast 40 to taper. The perimeter 60 is largest at the upper surface 52 and smallest toward the lower molding surface 41.

Once the negative material plaster cast 40 is made, a corresponding positive plaster cast 64 (FIG. 5) is made from it. In forming the positive plaster cast 64, the negative plaster cast 40 (FIG. 4) is coated with a thin film of a separating agent such as polyvinyl alcohol. Tooling plaster or plastic is then poured over the negative plaster cast 40, and the positive plaster cast 64 (FIG. 5) is formed. The draft angle facilitates separating the positive plaster cast 64 from the negative plaster cast 40 once the tooling plaster or plastic has hardened.

Figure 3:
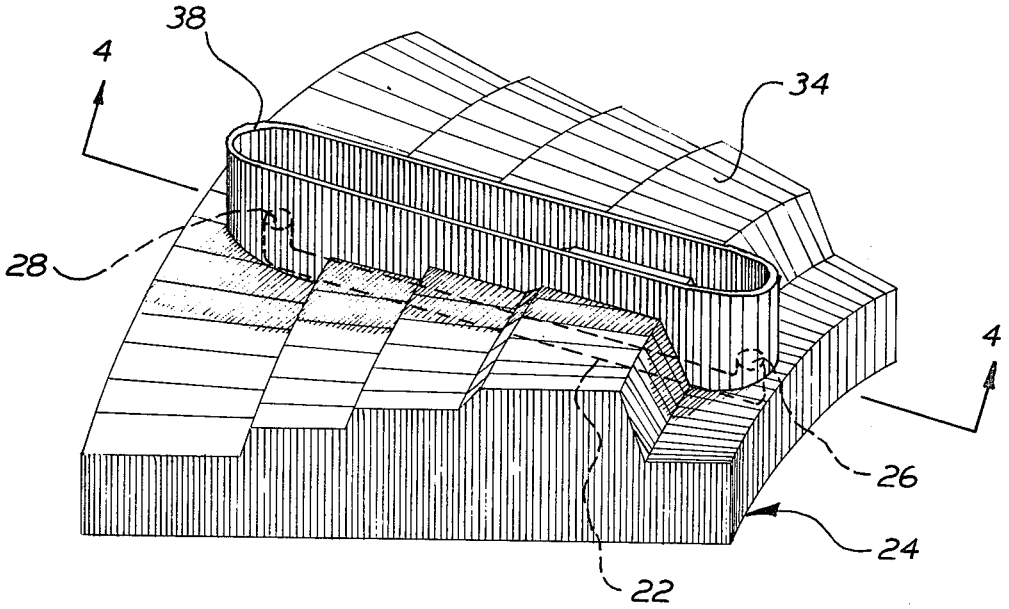
FIG. 3 is a pictorial illustration of the positive wax pattern of FIG. 2 after a fence or retaining wall has been placed around a selected portion of a surface of the pattern.

The positive cast 64 includes a recess 66 having a perimeter 68 shaped like the perimeter of the fence 38 (FIG. 3). The bottom surface 70 (FIG. 5) of the recess 66 includes recesses 72 and 74 which mark the eventual location of the ends of the passage 22 (FIG. 2). Also, the locating buttons 30 and 32 are duplicated by the plaster buttons 76 and 78 (FIG. 5) which project upward from the bottom surface 70 of the recess 66.

The outside shape of the positive plaster cast 64 is generally unimportant. It may be convenient to pour the wet plaster into a box or other container and then make an impression of the partial plaster negative 40 (FIG. 4) in the plaster.

Figure 4:
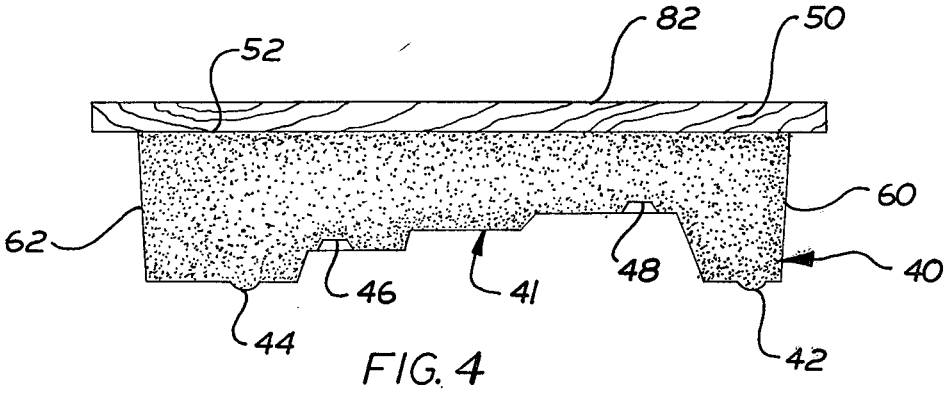
FIG. 4 is a sectional view similar to FIG. 2 but showing a negative partial plaster cast made by filling the fenced-off portion of the wax pattern of FIG. 3.

The positive plaster cast 64 (FIG. 5) will be used to produce a wax replica of the plaster negative 40 (FIG. 4) and mounting board 50. It is therefore convenient to make the top surface 80 of the positive plaster cast 64 even with the top surface 82 of the mounting board 50 (FIG. 4). Thus when the positive plaster cast 64 (FIG. 5) is filled with liquid wax or plastic, a wax negative 90 (FIG. 6) is produced. The wax negative 90 is identical in form to the partial plaster negative 40 (FIG. 4).

Figure 5:
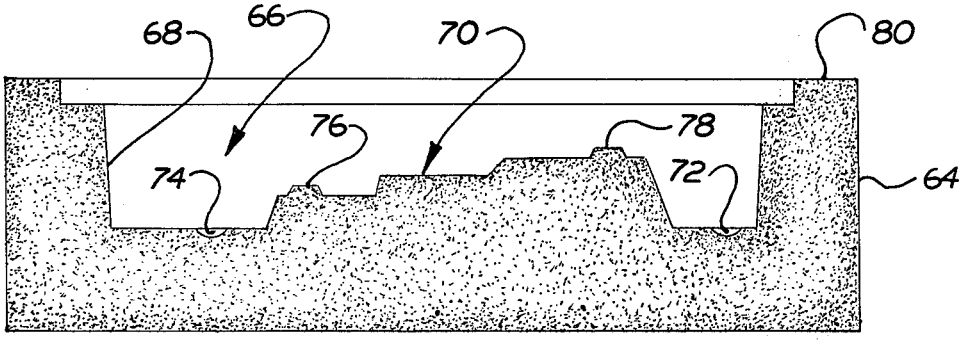
FIG. 5 is a sectional view showing a positive plaster cast made from the negative cast shown in FIG. 4.
Figure 6:
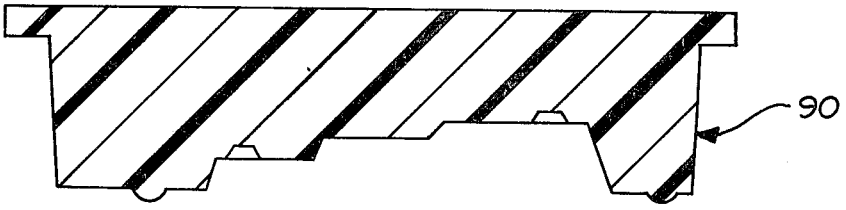
FIG. 6 is a sectional view showing a negative wax pattern made by pouring wax into the plaster cast illustrated in FIG. 5.
Figure 7:
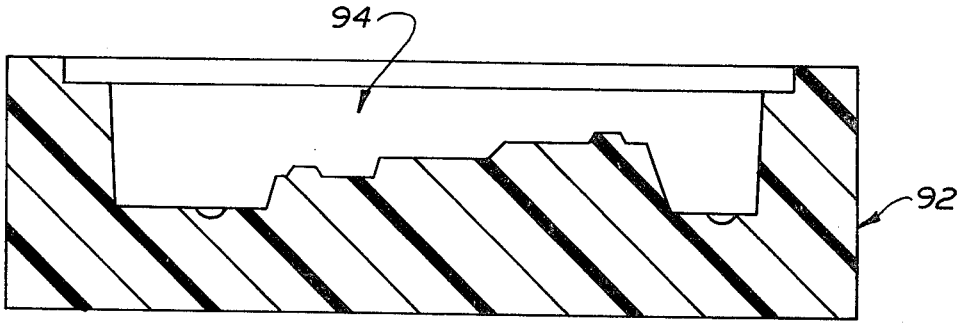
FIG. 7 is a sectional view showing a negative wax pattern made by pouring wax over the positive plaster cast shown in FIG. 4.

Similarly, the plaster negative 40 (FIG. 4) is used to make a wax positive 92 (FIG. 7). Molten wax is poured into a container (not shown). The container provides the exterior shape to the wax positive. The exterior shape of the wax positive 92 is not critical. However the interior recess 94 of the wax positive 92 has a form exactly the same as interior recess 66 in the plaster positive 64 (FIG. 5). The interior recess 94 (FIG. 7) is formed by impressing the plaster negative 40 (FIG. 4) into the molten wax.

Having now produced the wax positive 92 (FIG. 7) and the mating wax negative 90 (FIG. 6), the final mold 96 (FIG. 12) may be constructed. First the wax pattern 24 (FIGS. 8 and 9) is fixedly connected to the wax negative 90. This may be accomplished using any suitable cement or adhesive. The locating buttons 30 and 32 (FIG. 2) which were connected to the top surface 34 of the wax pattern 24 serve to accurately locate the wax negative 90 on the pattern.

Figure 9:
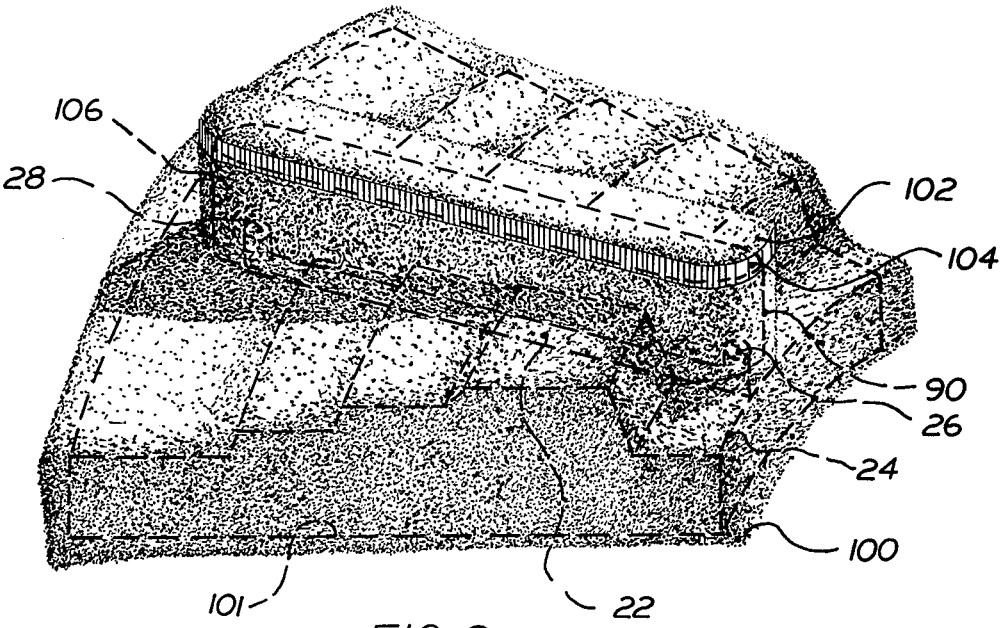
FIG. 9 is a pictorial illustration of the mold shown in FIG. 8.

The two patterns 24 and 90 are repeatedly dipped in a slurry of ceramic mold material until a coating 100 of sufficient thickness is built up. The top 102 is made removable by wiping the edge 104 of the wax negative 90 clean of slurry between each dipping. FIG. 9 illustrates the assembled wax pattern 24 and wax pattern 90 after the coating of ceramic material has been built up.

Figure 8:
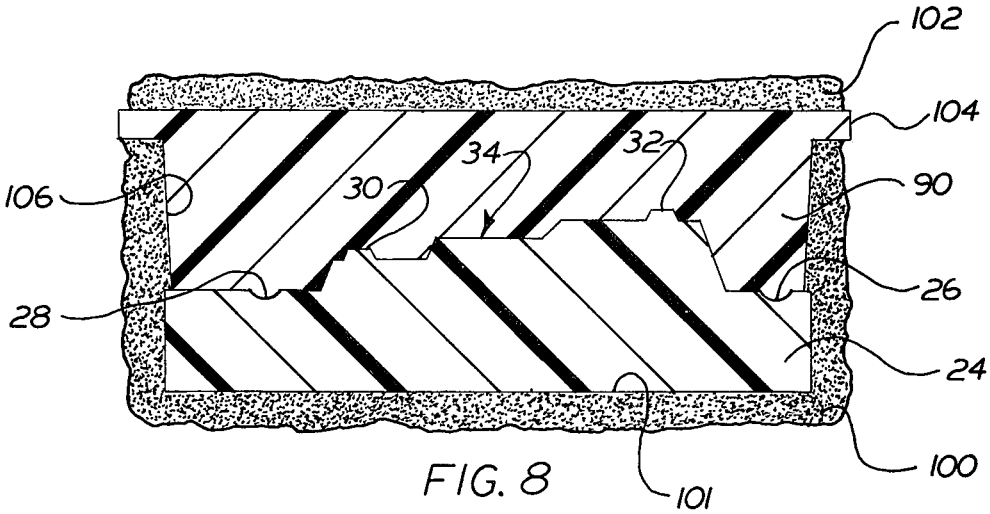
FIG. 8 is a sectional view showing a green ceramic mold section made by assembling the wax patterns shown in FIGS. 2 and 6 and dipping the assembly in a ceramic slurry.

The assembly shown in FIGS. 8 and 9 is ready to go to an oven for wax melt out. When wet coating of ceramic material has dried and the wax pattern 24 and wax negative 90 have been melted out and the top 102 removed, a ceramic main or lower mold section 100 (FIG. 12) is produced. The lower mold section 100 has an interior cavity with a casting surface 101 shaped exactly like the bottom of the wax pattern 24 (FIGS. 2, 3, 8, and 9). In addition, there is an accurately located opening or socket 106 in the mold 100 which surrounds the ends 26 and 28 of the passage 22. The socket 106 is formed by the ceramic mold material which surrounded the wax negative 90 (see FIGS. 8 and 9). The socket 106 forms a reference surface for the location of the secondary mold 108 formed in the following step.

Figure 10:
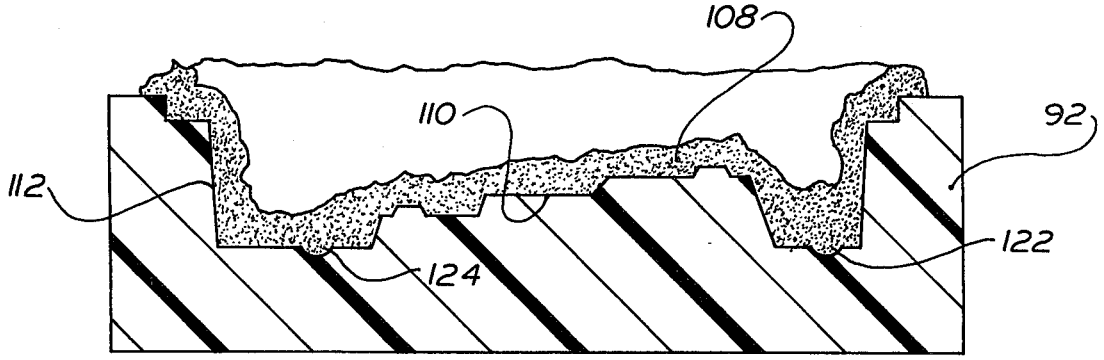
FIG. 10 is a sectional view showing a green ceramic mold section made by dipping the wax pattern shown in FIG. 7 in a ceramic slurry.

The positive wax pattern 92 is also dipped in slurry to build a layer of ceramic material FIG. 10. First the ceramic material is built up to a sufficient thickness, then the wax positive 92 is melted away leaving a secondary ceramic negative partial mold 108. The secondary partial mold 108 has an outer face surface or casting surface 110 which corresponds exactly to the portion of the upper surface 34 of the wax pattern 24 (FIG. 3) which was fenced in by the retaining wall 38. The tapering side surface 112 on the partial mold 108 fits exactly into the socket 106 in the lower mold section 100. Therefore the negative partial mold 108 is called a "plug mold".

After the lower mold 100 and the plug mold 108 have been fired, both may be inspected visually for defects or cracks. If the plug mold 108 is satisfactory, a core 120 (FIG. 11) is attached to the plug mold. The core 120 is made of a ceramic mold material and both it and the upper mold section 108 have been fired before being attached to each other. This method eliminates the necessity of attaching a fired core 120 to a green or unfired mold section 108 and permits interior inspection of the actual casting surfaces prior to filling the mold with molten metal.

The dimples or recesses which marked the eventual ends 26 and 28 of the passage 22 in the pattern 24 (FIG. 2) produce complimentary bumps or protrusions 122 and 124 (FIG. 10) respectively in the plug mold 108. The bumps 122 and 124 provide accurately placed markers for the location of the core 120. The bumps 122 and 124 may be removed to present a flat surface for the connection of the core 120, or the core may be formed with recesses to receive the bumps. At the same time the recesses 126 and 128 (FIG. 11) may be filled in (FIG. 12) with any suitable material.

Figure 11:
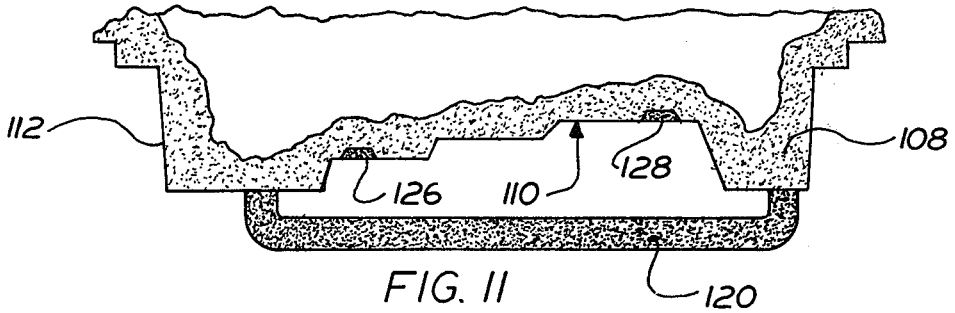
FIG. 11 is a sectional view showing the ceramic mold of FIG. 10 after the mold has been fired and a previously fired core has been attached.
Figure 12:
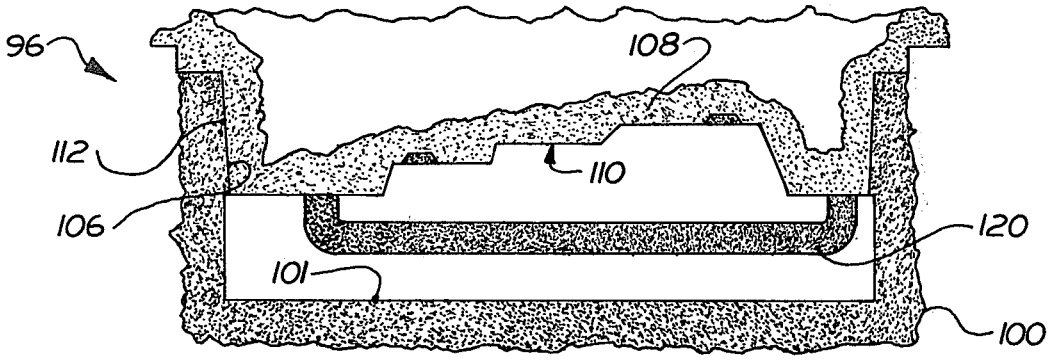
FIG. 12 is a sectional view showing a completed mold assembly made by firing the green ceramic mold section of FIG. 8 and inserting the mold section of FIG. 11.

The core 120 for producing an internal passage is connected with the plug mold 108 using any suitable cement or adhesive (FIG. 11). The plug mold is then placed in the socket 106 of the lower mold section 100 (FIG. 12). The plug mold 108 blocks the open end of the socket 106 and has an inner surface 110 with a configuration corresponding to the configuration of a portion of the outer surface of the article 20. The minor or lower mold section 100 has an inner surface area with a configuration which corresponds to the configuration of the remainder of the outer surface area of the article 20. The inner surface of the lower mold section 100 cooperates with the plug mold 108 to define a mold cavity having a configuration corresponding to the configuration of the article 20. The completed mold assembly 96 is now ready for use in a conventional investment casting process.

This it is clear that the present invention provides a new and improved method for making casting molds with interior passages. Two mold sections 100 and 108 (FIG. 12) combine to form a mold 96 having a cavity shaped like the desired finished casting. The two mold sections 100 and 108 have mating reference surfaces 106 and 112 which permit them to be accurately located with respect to one another. The two green mold sections 100 and 108 are fired to harden them and then an already fired ceramic core 120 is attached to one of the mold sections. The two mold sections 100 and 108 are then assembled together to form a finished mold 96.

In the practice of the present invention there is no thermal expansion cracking of either the mold 96 or the core 120 during firing of the mold since the core is not connected to a mold section until after both have been fired. Hidden damage to the mold 96 is almost entirely eliminated because the core 120 and the casting surfaces 101 and 110 which define the mold cavity in both mold sections 100 and 108 may be inspected after firing. In addition, the core 120 may be precisely located when it is attached to one of the mold sections. This assures that the passage 22 (FIG. 1) through the finished casting 20 formed by the core 120 (FIG. 1) will be accurately located.

I claim:

1. A method of forming a mold for use in casting, said method comprising the steps of, forming a positive pattern having a surface the shape of a part to be cast; forming a negative wax partial pattern having a casting surface complimentary to a selected portion of the surface of the positive pattern and a reference surface in a fixed spatial relationship with the casting surface; forming an assembly by accurately positioning the casting surface of the negative wax partial pattern in complimentary engagement with the selected portion of the surface of the positive pattern; forming a first mold section having a surface complimentary to the surface of the part by dipping the assembly formed in the preceding step in a ceramic material; forming a second mold section of ceramic material having a casting surface identical to the casting surface of the negative wax partial pattern and a reference surface identical to the negative wax partial pattern reference surface, the casting and reference surfaces bearing the same spatial relationship to each other as the identical surfaces of the negative wax partial pattern bear to each other; attaching a core to one of the mold sections; and forming a complete mold by placing the reference surface of the second mold section in abutting engagement with the reference surface of the first mold section thereby putting the casting surface of the second mold section in registry with the casting surface of the first mold section.

2. A method as set forth in claim 1 wherein prior to said step of attaching a core to one of the mold sections the core and the mold sections are fired.

3. A method as set forth in claim 1 wherein said step of forming a negative wax partial pattern includes the steps of placing a retaining wall around the selected portion of the positive pattern, forming a plastic material into a solid having a surface complimentary to the selected portion of the surface of the positive pattern and a surface complimentary to the inside surface of the retaining wall.

4. A method as set forth in claim 3 wherein said step of forming a second mold section includes the steps of forming a plastic material into a solid having a portion of its surface identical to the selected surface of the positive pattern and complimentary to the reference surface on the negative wax partial pattern, and dipping the solid so formed in a ceramic material.

5. A method as set forth in claim 1 further including the step of forming an intermediate pattern having a surface complimentary to the selected portion of the positive pattern and a surface identical to the reference surface and wherein said step of forming a negative partial wax pattern includes making a mold having surfaces complimentary to the surfaces of the intermediate pattern, filling the mold so formed with a disposable plastic pattern material and thereafter removing the plastic pattern material from the mold so formed to thereby form said negative partial wax pattern, and said step of forming a second mold section includes the steps of forming a mold of a disposable plastic pattern material having surfaces complimentary to the surfaces of the intermediate pattern, coating the mold so formed with a ceramic mold material, and thereafter removing the plastic pattern material to thereby form the negative partial wax pattern.

6. A method as set forth in claim 5 wherein said step of forming an intermediate pattern includes the steps of placing a retaining wall around a selected portion of the surface of the positive pattern, the interior surface of the retaining wall being complimentary to the reference surface, forming a hardenable material into complimentary engagement with the interior surface of retaining wall and the selected portion of the positive pattern, and separating the hardenable material so formed from the retaining wall and the positive pattern after it has hardened.

7. A method of forming a mold assembly for use in casting an article having an outer surface area and an internal passage with an opening in the outer surface area of the article, said method comprising the steps of providing a main pattern having an outer surface area with a configuration which corresponds to the configuration of at least a major portion of the outer surface area of an article, selecting a portion of the surface area of the main pattern which will correspond to a portion of the article surface area that includes the internal passage opening, providing a secondary pattern having a shaped outer surface area with a configuration which corresponds to the configuration of said selected portion of the surface area of the main pattern, interconnecting the main and secondary patterns with the shaped outer surface area of the secondary pattern abutting the outer surface area of the main pattern at a location corresponding to the selected portion of the surface area of the main pattern, at least partially covering the pattern assembly with ceramic mold material to form a main mold section defining a mold cavity with a configuration corresponding to the configuration of at least a major portion of the cast article and an opening in communication with said mold cavity at a location corresponding to the location of the selected portion of the surface area of the main pattern, providing a secondary mold section having a shaped surface area with a configuration which corresponds to the configuration of the shaped surface area of the secondary pattern, connecting to the shaped surface area of the secondary mold section a core having a configuration corresponding to the configuration of an internal passage, and connecting the secondary mold section with the main mold section with the core extending into the mold cavity and with the secondary mold section blocking the opening in the main mold section.

8. A method as set forth in claim 7 wherein said step of providing a secondary pattern includes the step of positioning a retaining wall around the portion of the outer surface area of the main pattern which corresponds to the selected portion of the surface area of the main pattern, and molding pattern material in a pattern mold cavity defined by said selected portion of the outer surface area of the main pattern and said retaining wall.

9. A method as set forth in claim 7 wherein said step of providing a secondary mold section includes the step of forming a ceramic secondary mold section by covering said selected portion of the surface area of the main pattern with a wet coating of ceramic mold material and drying the wet coating of ceramic mold material.

10. A method of forming a mold assembly for use in casting an article having an outer surface area and an internal passage with an opening in the outer surface area of the article, said method comprising the steps of providing a main mold section defining a mold cavity with a configuration corresponding to the configuration of at least a major portion of a cast article and an opening in communication with said mold cavity, said opening being at a location corresponding to a selected portion of the surface of a pattern used in shaping said mold section, said selected portion will correspond to a portion of the article surface area which includes an internal passage opening, providing a pattern cavity defined by a sidewall which circumscribes an area having a configuration which is the same as the configuration of the opening in the main mold section and a bottom wall with a configuration which is the same as the configuration of the selected portion of the surface of the pattern used in shaping said mold section, covering the side and bottom walls of the pattern cavity with a wet coating of ceramic mold material, drying the wet coating of ceramic mold material to form a secondary mold section having an outer face surface with a configuration which corresponds to the configuration of the selected portion of the surface of the pattern used in shaping said mold section and a side surface which encloses an area which is of the same configuration as the opening in the main mold section, attaching to the face surface of the secondary mold section a core having the same configuration as an internal passage in the article, and connecting the secondary mold section with the main mold section with the core extending into the mold cavity and with the secondary mold section disposed in the opening in the main mold section.

11. A method as set forth in claim 10 wherein said step of providing a main mold section includes the step of providing a disposable main pattern having an outer surface area with a configuration which corresponds to the configuration of the outer surface area of the article, at least partially covering the outer surface area of the main pattern with a wet coating of ceramic mold material while maintaining the selected portion of the surface area of the main pattern which would correspond to the surface area of the article provided with a passage opening free of the wet coating of ceramic mold material, drying the wet coating of ceramic mold material, and disposing of the main pattern to expose surfaces of the mold cavity, said step of providing a pattern cavity including the step of shaping pattern material against the surface area of the main pattern which corresponds to the selected portion of the surface area of the main pattern to form an intermediate pattern having an outer surface area with a configuration which corresponds to the configuration of the selected portion of the surface area of the main pattern, and shaping pattern material against the outer surace area of the intermediate pattern to form a secondary pattern having a surface area defining the pattern cavity.

12. A method of forming a mold for use in casting an article having an internal passage, said method comprising the steps of forming a main pattern having an outer surface area which is of the same configuration as the configuration of the outer surface area of an article, forming a secondary pattern having an outer surface which is of the same configuration as the configuration of a portion of the outer surface area of the main pattern, interconnecting the main and secondary patterns to form a pattern assembly, at least partially covering the pattern assembly with a wet coating of ceramic mold material, at least partialy drying the wet coating of ceramic mold material to form a main mold section, forming a third pattern defining a pattern cavity with a configuration corresponding to the configuration of the outer surface area of the second pattern, at least partially covering the pattern cavity with a wet coating of ceramic mold material, at least partially drying the wet coating of ceramic mold material in the pattern cavity to form a secondary mold section, attaching to one of the mold sections a core having a configuration corresponding to the configuration of an internal passage to be formed in the article, and interconnecting the main and secondary mold sections after performing said step of attaching the core to thereby form a mold assembly.

* * * * *